US006948560B2

(12) United States Patent
Marsh

(10) Patent No.: US 6,948,560 B2
(45) Date of Patent: Sep. 27, 2005

(54) JAR FOR USE IN A DOWNHOLE TOOLSTRING

(75) Inventor: Brent Marsh, Bournemouth (GB)

(73) Assignee: Varco I/P, Inc., Houston, TX (US)

( * ) Notice: Subject to any disclaimer, the term of this patent is extended or adjusted under 35 U.S.C. 154(b) by 9 days.

(21) Appl. No.: 10/785,081

(22) Filed: Feb. 25, 2004

(65) Prior Publication Data

US 2005/0183889 A1 Aug. 25, 2005

(51) Int. Cl.[7] ..... E21B 31/107
(52) U.S. Cl. ..... 166/178; 175/302; 175/304
(58) Field of Search ..... 166/178; 175/302, 175/304, 301

(56) References Cited

U.S. PATENT DOCUMENTS

| | | | | |
|---|---|---|---|---|
| 2,336,564 A | * | 12/1943 | Osmun | 175/297 |
| 2,621,025 A | * | 12/1952 | Denning | 175/304 |
| 2,733,046 A | * | 1/1956 | Thompson | 175/303 |
| 2,962,098 A | * | 11/1960 | Conrad | 175/304 |
| 3,139,126 A | | 6/1964 | Fromm et al. | |
| 3,406,770 A | * | 10/1968 | Arterbury et al. | 175/299 |
| 3,685,598 A | | 8/1972 | Nutter | |
| 3,685,599 A | * | 8/1972 | Kisling, III | 175/304 |
| 3,880,249 A | * | 4/1975 | Anderson | 175/302 |
| 4,333,542 A | | 6/1982 | Taylor | |
| 4,607,692 A | | 8/1986 | Zwart | |
| 5,022,473 A | * | 6/1991 | Taylor | 175/299 |
| 5,052,485 A | | 10/1991 | Reid | |
| 5,069,282 A | | 12/1991 | Taylor | |
| 5,170,843 A | * | 12/1992 | Taylor | 166/301 |
| 5,267,613 A | | 12/1993 | Zwart et al. | |
| 5,688,402 A | | 11/1997 | Green et al. | |
| 5,709,268 A | | 1/1998 | Estilette, Sr. | |

FOREIGN PATENT DOCUMENTS

| | | |
|---|---|---|
| EP | 0 298 683 A2 | 1/1989 |
| EP | 1 206 956 A2 | 5/2002 |
| GB | 2 254 646 A | 10/1992 |

* cited by examiner

*Primary Examiner*—Hoang Dang
(74) *Attorney, Agent, or Firm*—Finnegan, Henderson, Farabow, Garrett & Dunner LLP

(57) ABSTRACT

A jar (10), for use in a downhole toolstring comprising: a hollow housing (11); a jar mandrel (13); a latch sub (14); one or more latch keys (16); a cam surface (17); a chamber (23); a compression spring; and an adjuster (24). The hollow housing (11) supports, moveably retained therein, the jar mandrel (13). The jar mandrel (13) and the latch sub (14) are releasably securable together by means of the one or more latch keys (16), and each latch key (16) is moveable between a latching position, in which the latching sub (14) and the jar mandrel (13) are connected together, and a release position permitting separation thereof. The cam surface (17) engages each latch key (16) to move it from its latching position to its release position when the jar mandrel (13) occupies a preselected position in the housing (11). The compression spring (24) is constrained within the chamber (23) and acts between the latch sub (14) and the hollow housing (11) to bias the jar mandrel (13) when connected to the latch sub (14) away from the predetermined position; and the adjuster (27) includes an adjuster mandrel (47) that is rotatable relative to the hollow housing and has an external portion (49) that is engageable from outside the hollow housing (11) via a side thereof. An adjuster portion (51) is threadedly connected to the jar mandrel (13) such that rotation of the adjuster mandrel (47) relative to the jar mandrel (13) alters the length of the chamber (23) and hence the degree of compression of the compression spring (24).

12 Claims, 2 Drawing Sheets

JAR FOR USE IN A DOWNHOLE TOOLSTRING

BACKGROUND OF THE INVENTION

This invention relates to a jar for use in a downhole toolstring.

When exploring for oil or gas, or when preparing a wellbore for production, it is common practice in the oil and gas industries to employ strings of tools.

These toolstrings are lowered or driven into the wellbores, and include various devices that are activatable within the wellbores at the downhole location to carry out predetermined tasks.

The wellbore is rarely straight and parallel-sided.

This is sometimes because it is necessary to drill portions of the wellbore at angles to other parts thereof, in order to avoid difficult geological formations and more significantly to ensure that the wellbore perforates as much as possible of the hydrocarbon-bearing fields.

Furthermore, the pressures which exist below ground in wellbores can be very significant. These pressures can cause shales and other comparatively soft geological types to encroach into a wellbore, thereby rendering the wellbore non-uniform.

Another cause of non-uniformity of a wellbore is so-called "wash out", caused when fluids in a surrounding rock formation cause decay and/or collapse of the wellbore.

All of the foregoing causes of non-uniformity can cause difficulty when attempting to operate exploration and/or production tooling within the wellbore.

For example, a common problem is for a toolstring that is being lowered into the wellbore on a wireline (i.e. a comparatively thick cable that supports, and sometimes conveys data transmission cables to, the downhole toolstring) to pass through a narrowed or deviated portion of the wellbore, and subsequently become stuck at that location as the wireline is being wound into a surface location to withdraw the toolstring.

Under such circumstances, there is a limit to the pull force that surface-located operators can apply via the wireline.

This is primarily because of the risk of breaking the wireline, thereby leaving the toolstring stuck in the wellbore.

Wireline used is usually either termed "slickline" comprising a single strand, common sizes being 0.108" and 0.125" diameter; or "braided line" comprising multi-strands of thinner wire which is wound or braided to give strength. This is available in common diameter sizes of 3/16" and 7/32" and sometimes larger. This type is stronger and more often utilized for "heavy duty" operations such as fishing.

Under such circumstances it is necessary to wind in the entire length of the wireline (over, perhaps, many of tens of thousands of feet), and then send into the wellbore a more robust cable carrying further tooling for cleaning the end of the broken wireline, and attaching to the toolstring for the purpose of attempting to withdraw it.

This practice suffers disadvantages, not least because it is time-consuming.

Since the operational time of an oil rig is typically costed in tens of thousands of dollars per day it is essential that rig operators recover stuck tooling as quickly as possible.

For this reason it has become commonplace to include a so-called "jar" in a toolstring.

In general terms, a mechanical spring jar is a device included in a toolstring that when needed utilities the limited pull force available via the wireline to cock a mass against a spring, and subsequently release it so that the energy resulting from tensioning of the wireline drives the mass into a part of the toolstring.

This imparts an impulse to the toolstring, which often is adequate to free the stuck tool.

Patents numbers U.S. Pat. No. 5,052,485 and U.S. Pat. No. 5,267,613 describe two known types of jar.

It is known to provide an adjustment mechanism in a toolstring jar, for adjusting the pull force needed to tension the wireline. Thus it is possible to match the force needed to operate the jar to the strength of the wireline being used and/or the mass of the toolstring, before the toolstring is inserted into the wellbore.

One known form of jar includes a cylindrical housing having a hollow, cylindrical interior.

Within the interior a jar mandrel and a latch sub are releasably secured together, with the jar mandrel located in use above the latch sub.

The latch sub includes a collar or other protuberance that bears against a compression spring defining a hollow cylinder. The latch sub and/or the jar mandrel extends through the center of the spring, the end of which opposite the collar bears against a further protuberance protruding from the wall of the hollow housing. The further protuberance and the collar between them define an elongated chamber for the compression spring.

The means of securing the jar mandrel and the latch sub together includes an annular array of latch keys that are moveable radially inwardly and outwardly relative to the jar mandrel.

A series of springs or other resiliently deformable members urges the latch keys to a radially outward position in which they engage a groove or recess formed in the radially inner surface at the upper end of a hollow, cylindrical latch sub. The groove is machined during manufacture of the latch sub, to define an annular shoulder of corresponding profile to the latch keys.

The interior of the housing includes one or more cam surfaces that, on movement of the jar mandrel upwardly in the housing, engage the latch keys.

This causes the latch keys to drive inwardly relative to the jar mandrel. This in turn causes their release from the latch fingers of the latch sub.

When the jar mandrel and latch sub are secured together any such upward movement of the jar mandrel involves similar movement of the latch sub. Therefore, the initial movement occurs against the force of the compression spring acting between the collar and the protuberance extending from the housing wall.

Thus when the cam surface causes release of the latch keys from the latch fingers, stored potential energy in the wireline reacts suddenly to drive the jar mandrel further upwardly within the housing, causing a hammer member secured to the jar mandrel to strike an anvil defined within the housing and thereby confer an upwardly acting impulse on the housing, and hence any further part of the toolstring secured thereto.

A portion of the jar mandrel at the upper end thereof protrudes via an aperture in the upper end of the housing.

This end of the jar mandrel includes a conventional rope socket for attachment to a wireline, such that when the toolstring is stuck in the bore the wireline is usable to draw the jar mandrel and latch sub upwardly against the action of the compression spring until the cam surface causes release of the latch keys from the latch fingers.

Typically the toolstring includes, located immediately below the rope socket, a number of weight bars. During the upward motion of the jar mandrel and latch sub the wireline stretches. When the latch keys release the resulting potential energy in the wireline converts to kinetic energy which accelerates the mass of the weight bars.

The rapid upward motion of the weight bars drives the hammer into FINNEGAN the anvil, to create the impulse on the stuck tool as aforesaid. It is, by this means, possible to confer significant impulses on the toolstring.

The length of the latch sub relative to the jar mandrel is effectively adjustable, by reason of its upper end passing through a bulkhead in the lower end of the housing, the dimensions of the latch sub above the bulkhead and the aperture through which it passes being such as to prevent withdrawal of the latch sub downwardly through the bulkhead.

The opposite (in use lower) end of the latch sub extends towards the open, lower end of the housing and is threaded. An adjuster nut is threaded onto the end of the protruding threaded portion. It is thereby possible to apply a spanner to the adjuster nut and drive it upwardly and downwardly relative to the housing, by turning the adjuster nut clockwise or anticlockwise.

Since the compression spring lies between the aforesaid bulkhead and a washer resting on the adjuster nut so as to encircle the latch sub, adjusting the adjuster nut in this way alters the length of the chamber containing the compression spring.

Such adjustment of the length of the chamber in turn alters the pre-load applied to the compression spring. This in turn affects the force needed to draw the latch sub and jar mandrel upwardly until the latch keys engage the cam surface. Thus it is possible to match the operating load of the jar to the strength of the wireline being used to lower and/or control the pull string; and/or to the mass of the toolstring, by altering the effective stiffness of the jar. When the level of pre-load is high, stretching of the wireline commences at lower wireline tension than when the pre-load is less (giving rise to a less stiff system overall).

However, the aforesaid method of adjusting the operating load of the jar is inconvenient.

This is principally because it is necessary to unscrew the jar from the toolstring in order to effect the adjustment.

This in turn involves withdrawing the toolstring, perhaps over the total depth of a long well, to a surface location. This may take several hours.

Thereafter it is necessary to remove the toolstring from the well; to disconnect the wireline from the upper end of the jar; and remove the jar from the toolstring. Only thereafter is it possible to apply the spanner to the adjuster nut in the free, lower end of the jar. Following these steps the time-consuming process of re-assembling the toolstring and lowering it back into the wellbore commences.

In view of the great cost of oil and gas rig downtime, there is a strong need for a more efficient method of adjusting the operating load of a mechanical spring jar.

Furthermore, in recent years the strength of the wirelines generally has increased.

This means that the wirelines are capable of operating the jars with ever larger springs and at ever increasing amounts of pre-load.

However, the latch sub shoulder and the latch keys limit the loads at which the jar mandrels and latch subs separate from one another.

In particular, a known latch key and latch sub groove combination FINNEGAN includes a latch key having a shaped outer surface that presents a recess having one or more upwardly facing shoulders. The latch sub groove includes a protuberance of complementary shape to the recess. The use of high loads in the wirelines causes the pairs of protuberances to slide one over the other thereby causing separation of the jar mandrel and latch sub even before the latch keys engage the cam surface.

Also, the repeated use of high loads causes premature wear in the latch keys and groove.

Thus, there is also a need in the design of a jar for a more effective arrangement for securing the components together before their intended separation.

SUMMARY OF THE INVENTION

According to a first aspect of the invention, a jar for use in a downhole toolstring comprises:

a hollow housing;

a jar mandrel;

a latch sub;

at least one latch key;

a cam surface;

a chamber;

a compression spring; and an adjuster, wherein:

the hollow housing supports, moveably retained therein, the jar mandrel and the latch sub;

the jar mandrel and the latch sub are releasably securable together by means of at least one latch key, each said at least one latch key being moveable between a latching position, in which the latching sub and the jar mandrel are connected together and a release position permitting separation thereof;

the cam surface is engageable with the at least one latch key to move the at least one latch key from said latching position to said release position when the jar mandrel occupies a preselected position in the housing;

the compression spring is constrained within the chamber and acts between the latch sub and the hollow housing to bias the jar mandrel when connected to the latch sub away from the preselected position; and the adjuster includes an adjuster mandrel that is rotatable relative to the hollow housing and has an external portion that is engageable from outside the hollow housing via a side thereof, and an adjuster portion that is threadedly connected to the jar mandrel such that rotation of the adjuster mandrel relative to the jar mandrel alters the length of the chamber and hence the degree of compression of the compression spring.

This arrangement advantageously permits adjustment of the preload on the compression spring of a jar, without requiring dismantling of the toolstring in which the jar is incorporated. This saves rig downtime.

Conveniently, the jar mandrel includes an end protruding from the hollow housing; and a wireline connecter secured to the said end, outside the hollow housing.

More preferably, the hollow housing includes rigidly secured thereto, typically on its inside, an anvil; and the jar mandrel includes a hammer member that is strikeable against the anvil under the influence of a stretched wireline following separation of the jar mandrel from the latch sub.

The foregoing features advantageously allow the jar of the invention to have the characteristics of conventional jars that are familiar to those skilled in the art.

Preferably the adjuster mandrel includes at one end within the hollow housing a shank having a threaded end and the compression spring defines a hollow, cylindrical shape such that the shank extends through a central bore thereof, the adjuster including a nut that is secured to the adjuster mandrel threadedly received on the said end of the shank.

This arrangement is advantageously compact. It permits the ready adoption of the adjuster arrangement defined hereinabove.

Conveniently the compression spring includes seriatim in mutual engagement with one another a first spring section, having a first spring rate; and a second spring section having a second spring rate.

Conveniently the hollow housing includes formed therein an elongate, through-going aperture permitting viewing of the location of the adjuster relative to the housing.

Also preferably the housing has marked thereon adjacent to the aperture one or more distance markings.

This allows the setting of the adjuster to confer a predetermined degree of pre-load on the compression spring.

Typically the housing would include three distance markings (although other numbers of markings are possible), corresponding to per se known FINNEGAN "low", "medium" and "high" levels of pre-load.

In a particularly preferred embodiment of the invention the external portion of the adjuster mandrel includes a jar as defined hereinabove; the external portion of the adjuster mandrel includes a collar that is moveable relative to the remainder of the adjuster mandrel and has a protuberance that is engageable with a shoulder defined in the hollow housing; and the adjuster mandrel includes a threaded portion having threadedly engaged therewith a lock nut that on tightening engages the collar to force the protuberance into engagement with the shoulder and thereby prevent operation of the adjuster.

It is also preferable that the latch sub includes a hollow interior having formed in a surface thereof two or more latch shoulders; and each latch key has at least two latch surfaces, each latch surface of a said latch key being engageable with a said shoulder of the adjacent latch sub, when the latch key occupies its latching position with the jar mandrel received in the hollow interior of the latch sub.

This arrangement advantageously solves the problem, known in the prior art, of high strength wirelines permitting use of loadings that cause premature separation of the jar mandrel and latch sub components of conventional jars.

In one embodiment of the invention each said latch key includes one or more resiliently deformable biassers biasing it towards its latching position.

The invention also resides in a jar, for use in a downhole toolstring comprising:

a hollow housing;

a jar mandrel;

a latch sub;

at least one latch key;

a cam surface;

a chamber;

a compression spring; and an adjuster, wherein:

the hollow housing supports, moveably retained therein, the jar mandrel and the latch sub;

the jar mandrel and the latch sub are releasably securable together by means of the at least one latch key, each said latch key being moveable between a latching position, in which the latching sub and the jar mandrel are connected together and a release position permitting separation thereof;

the cam surface is engageable with the at least one latch key to move it from its latching position to its release position when the jar mandrel occupies a preselected position in the housing;

the compression spring is constrained within the chamber and acts between the latch sub and the hollow housing to bias the jar mandrel when connected to the latch sub away from the preselected position;

the adjuster includes an adjuster mandrel that is rotatable relative to the hollow housing and has mandrel an external portion that is engageable from outside the hollow housing, wherein the latch sub includes a hollow interior having formed in a surface thereof two or more latch shoulders; and each latch key has at least two latch surfaces, each latch surface of a said latch key being engageable with a said shoulder of the latch sub, when the latch key occupies its latching position with the jar mandrel received in the hollow interior of the latch sub.

In other words, the invention resides in a jar having the dual-surface latch keys referred to above, in the absence of the adjuster mechanism also defined herein.

The accompanying drawings, which are incorporated in and constitute a part of this specification, illustrate one embodiment of the invention and together with the description, serve to explain the principles of the invention.

DESCRIPTION OF THE EMBODIMENTS

Figure 1:
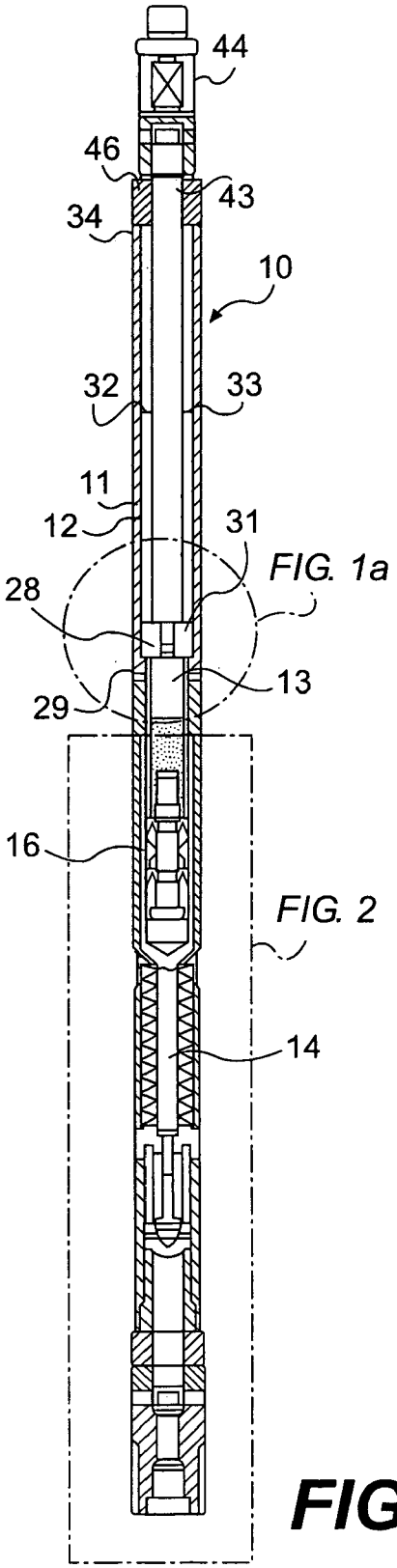
FIG. 1 is a longitudinally sectioned view of a jar according to the invention.

Reference will now be made in detail to the present embodiment of the invention, an example of which is illustrated in the accompanying drawings. Wherever possible, the same reference numbers will be used throughout the drawings to refer to the same or like parts.

Referring to the drawings, which depict a non-limiting example of the preferred embodiment of the invention, a jar 10 comprises a hollow, cylindrical housing 11 typically manufactured from a high grade steel or any of a range of other materials commonly used in the manufacture of downhole tools.

Elongated, hollow housing 11 defines an elongate hollow, cylindrical interior 12 within which a jar mandrel 13 and a latch sub 14 are retained so as to be slideable longitudinally in interior 12.

The jar 10 is shown in its in-use configuration, with the jar mandrel 13 lying above the latch mandrel 14.

The jar mandrel 13 and latch sub 14 are cylindrical components whose diameter is generally slightly smaller than that of interior 12, whereby they are a sliding fit within the interior 12.

The combined length of the jar mandrel 13 and latch sub 14 is less than the overall length of the hollow interior 12, thereby permitting the aforesaid sliding movement.

About its cylindrical, lower end 13*a* jar mandrel 13 has secured thereto in a circular pattern a series of latch keys 16, which secure the jar mandrel 13 and latch sub 14 together.

In the embodiment shown, there are two latch keys 16 arranged at 180 degree intervals about the pitch circle defined by the cylindrical lower end 13*a*. Other numbers of the latch keys are possible in other embodiments of the invention. Typically but not necessarily they would be arranged at equal angular spacings about the aforesaid pitch circle.

The hollow interior 12 includes a cam surface 17 which in the embodiment shown in the drawings is defined by a sleeve 18 secured on the inner surface of interior 12 and including a radially inwardly tapering lead-in surface 19.

Thus the cam surface 17 constitutes a region of interior 12 that is of progressively and uniformly decreasing diameter leading into a parallel-sided portion 21.

Other means of forming a cam surface 17 are of course possible within the scope of the invention. For example, a series of protuberances may replace or augment the sleeve 18.

Adjacent the upper end of latch mandrel 14 the hollow interior 12 defines a downwardly facing shoulder 22 defining one end of a hollow chamber 23.

Chamber 23 is an elongate, cylindrical chamber containing a compression spring 24 that is shaped essentially as a hollow cylinder.

The upper end of compression spring 24 reacts against shoulder 22.

The lower end of compression spring 24 reacts against an adjuster nut 26, described in more detail below, that defines the lower end of chamber 23.

Jar 10 includes an adjuster represented generally by numeral 27.

The jar mandrel 13 includes rigidly secured thereto a hammer member 28 above the sleeve 18 through which the jar mandrel extends.

Hammer member 28 is in the form of a fluted boss. Thus a cylindrical boss is divided by four angularly equi-spaced, elongate flutes 29 to define four quarter-cylindrical lands 31.

The purpose of the flutes 29 is to allow fluid flow past the hammer 28, thereby negating any piston effect that might otherwise arise in hollow interior 12. Consequently jar mandrel 13 is slideable longitudinally and rotatable in hollow interior 12, along the portions identified by reference numerals 32 and 33.

The hammer member 28 is secured on the jar mandrel 13 by means of interengaging threaded parts. Lockscrews or other securing means may be used to prevent rotation of hammer member 28 relative to jar mandrel 13.

Figure 2:
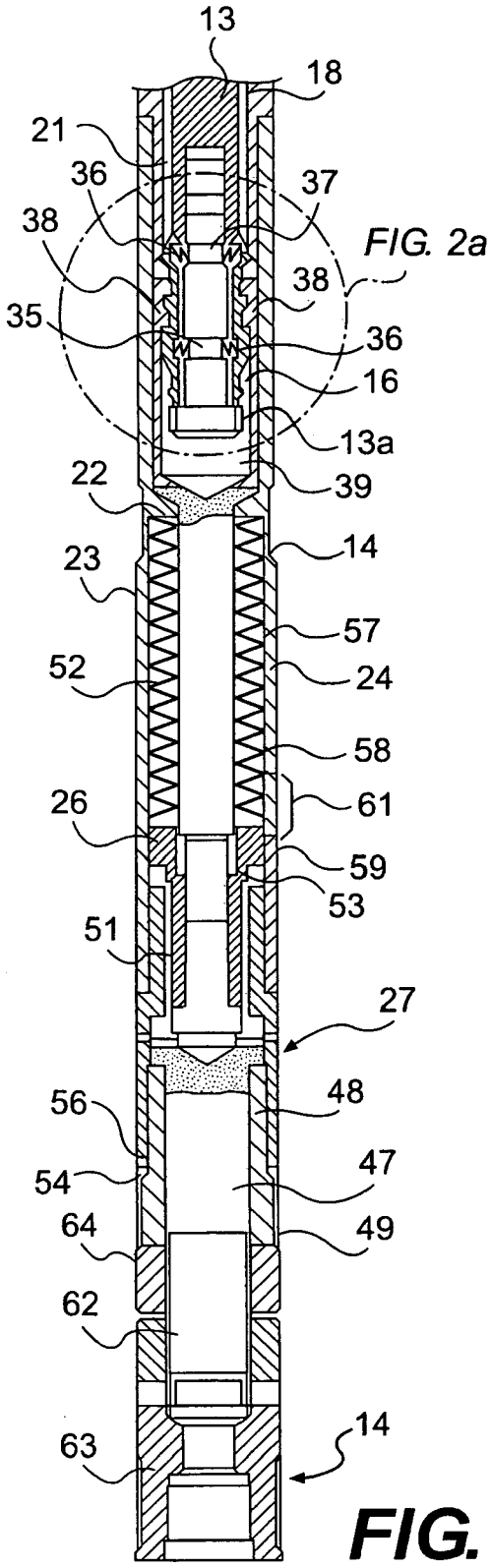
FIG. 2 is an enlargement of the portion of FIG. 1 delineated by chain lines.
Figure 2A:
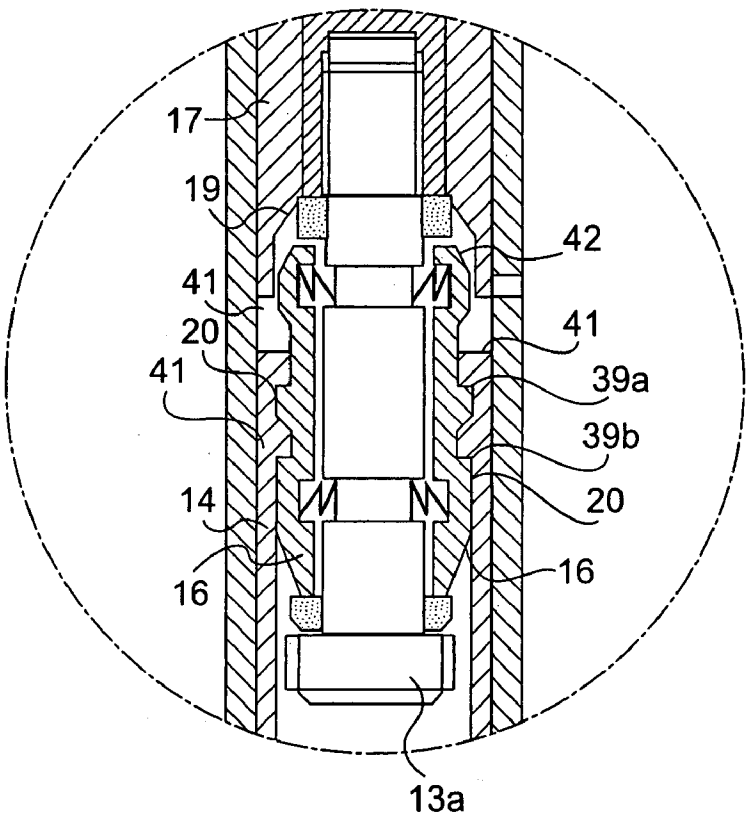
FIG. 2*a* is an enlargement of the circled portion of FIG. 2.
Figure 1A:
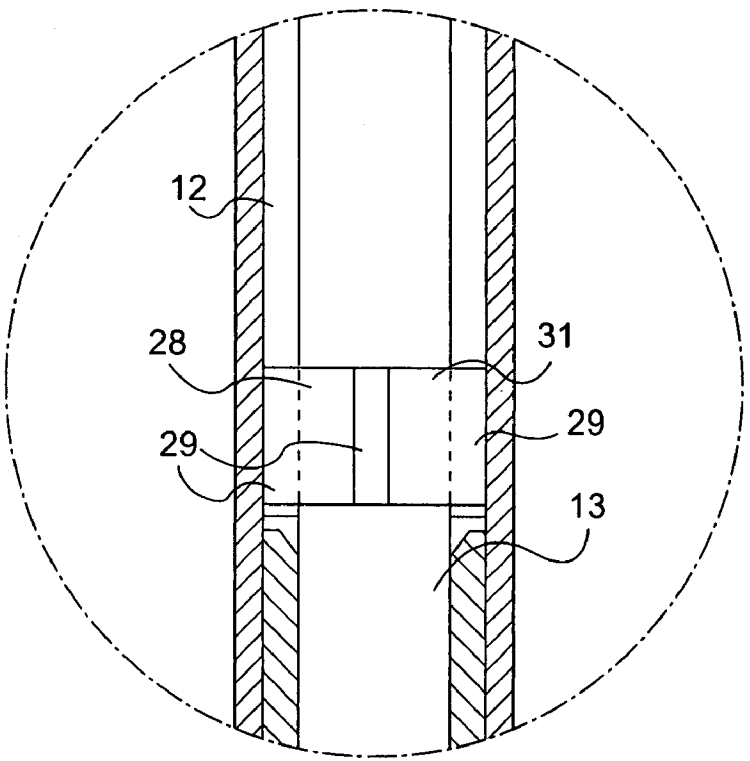
FIG. 1*a* is an enlargement of the circled portion of FIG. 1.

As best shown in FIGS. 2 and 2*a*, each latch key 16 is held moveably captive relative to the cylindrical lower end of jar mandrel 13.

Each latch key 16 is moveable radially inwardly and outwardly relative to jar mandrel 14. A respective compression spring 36 acts radially between the jar mandrel 13 and each end of each latch key 16, to bias the latch keys to a radially outermost (latching) position relative to the jar mandrel 13.

Although not visible in FIG. 2, the compression springs 36 are rigidly secured at either end respectively to a part of a latch key and a groove 37 formed in the cylindrical end of jar mandrel 13 thereby preventing complete separation of the latch keys from the jar mandrel 13 in the radial direction.

When so biased by the compression springs 36 the latch keys 16 occupy a latching position permitting load-transferring securing together of the jar mandrel 13 and the latch sub 14.

When compressed radially inwardly against the action of the compression springs 36 the latch keys 16 occupy the release position, in which the jar mandrel 13 and the latch sub 14 are separable one from the other.

Each latch key 16 includes a pair of in-use upwardly projecting, longitudinally spaced surfaces 20 defined by grooves as shown in FIG. 2.

The jar 10 includes a hollow, cylindrical interior having formed on its interior surface a latching groove 38 at the upper end of latch sub 14.

The latching groove 38 defines a pair of axially spaced, radially inwardly directed protuberances 41 located in use of the jar one above the other. The protuberances define a pair of downwardly facing shoulders 39*a*, 39*b* as shown.

When as shown the latching groove 38 overlies the latch keys 16 and the latter occupy their latching position to which they are urged by the springs 36, the shoulders 39*a,b* defined by protuberances 41 and the surfaces 20 engage to permit the transfer of longitudinally acting forces between the latch sub 14 and the jar mandrel 13.

The presence of two shoulders 39 in the latching groove 38, that engage respectively with pairs of upwardly directed surfaces formed in the latch keys 16, confers considerably greater reliability on the connection between the jar mandrel 13 and the latch sub 14 than has hitherto been the case.

The cam surface 17 is engageable against a follower surface 42 formed on a upper, exterior end of each latch key 16. Consequently on movement of the jar mandrel upwardly relative to the housing 11 (as a result of an upward pull on jar mandrel 13) the follower surface of 42 of each latch key 16 engages tapered lead-in portion 19 of cam surface 17 thereby driving the latch keys 16 radially inwardly relative to jar mandrel 13 and causing their disengagement from the latch groove 38 by the time the latch keys 16 have substantially or completely entered the parallel sided portion 21 of the sleeve 18 defining the cam surface 17.

The compression spring 24 is constrained within the chamber 23 and, as noted, acts between the adjuster nut 26 and the shoulder 22 forming part of hollow housing 11.

As described below, adjuster nut 26 is secured to and forms part of latch sub 14 thereby biasing jar mandrel 13 when it is connected to the latch sub 14 away from the position in which the followers 42 engage the cam surface 17.

The uppermost end of the jar mandrel 13 protrudes through an opening 43 defined in the uppermost end of housing 11.

The upper, free end of jar mandrel 13 terminates in a rope socket wireline connector 44 or another type of connector, of conventional design.

When a tool string in which the jar 10 of the invention is secured becomes stuck in a wellbore, tension applied via a wireline connected to rope socket 44 will draw the jar mandrel 13 and the latching sub when connected to it as shown in an upward direction.

This will occur against the resilience of the compression spring 24, which during such motion will be compressed between the adjuster nut 26 and the shoulder 22 until the followers 42 of the respective latch keys 16 engage the cam surface 17 thereby causing disengagement of the jar mandrel from the latch sub 14.

At this point the potential energy in the wireline converts to kinetic energy which drives the jar mandrel 13 explosively upwardly. Since typically the jar 10 includes several weight bars secured immediately below the rope socket 24, these too drive upwardly with considerable momentum.

This causes the hammer member 28 to strike the end of an anvil in the form of a sleeve 34 lining the in-use upper end of the interior of housing 11, thereby imparting an impulse. This transfers via a shoulder 46, to housing 11. This in turn applies the impulse to the tool string below the jar, thereby tending to free any stuck tooling.

As discussed hereinabove, it is desirable to adjust the effective rate of the spring 24 in order to accommodate differing tensile strengths of wireline used in conjunction with the jar 10; and differing toolstring masses.

This is because, as noted, it is important for the connection between the jar mandrel 13 and the latch sub 14 to release, before the strain in the wireline causes rupturing of the wireline itself.

To this end the jar 10 of the invention includes an adjuster mandrel 47 forming part of adjuster 27.

Adjuster mandrel 47 is rotatable relative to housing 11.

Adjuster mandrel 47 includes a cylindrical portion 48 received within hollow housing 11 in the region below compression spring 24; and an external portion 49 that is engageable, e.g. by hand or by the application of a tool, from outside the hollow housing 11 via a side thereof.

This contrasts with the prior art arrangement in which an adjuster nut is accessible only via the lowermost end of the adjuster of the jar 10.

The adjuster mandrel includes an adjuster portion 51 that is a hollow, cylindrical member secured to adjuster mandrel 47 so as to be rotatable therewith.

Adjuster portion 51 terminates in adjuster nut 26.

Latch sub 14 includes extending downwardly from the cylindrical portion 39 a shaft or shank 52.

Shaft 52 extends through the central bore defined in compression spring 24 and terminates at its in-use lowermost end in a threaded portion 53.

Adjuster nut 26 is threadedly received on threaded portion 53.

External portion 49 of adjuster mandrel 47 includes an annular protuberance 54 that engages an annular shoulder 56 at the lower end of housing 11.

Thus rotation of adjuster mandrel 49, by reason of engagement of external portion 49 thereof, causes rotation of adjuster nut 26 on adjuster portion 51. This causes tightening or loosening of adjuster nut 26 onto the threaded end portion 53 of shank 52, thereby adjusting the length of chamber 23 and applying greater or lesser amounts of pre-load, at the option of the user, to the compression spring 24.

Since the degree of pre-load affects the ease with which it is possible to draw a latch sub 14 upwardly relative to housing 11, rotation of the adjuster mandrel permits ready accommodation of different wireline tensile strengths and toolstring weights.

Since the adjuster mandrel 47 is accessible from outside the housing 11, without having to remove the jar 10 from the tool string, the adjustment process is facilitated and made considerably quicker than the prior art techniques.

In the apparatus of the invention, the annular end of sleeve 34 serves as an anvil member. However, within the scope of the invention other forms of hammer member 38 and anvil member 34 than those shown are possible.

As is evident from FIGS. 1 and 2, the compression spring 24 in the preferred embodiment is a composite spring comprising two spring portions 57, 58 of differing spring rates.

Each spring portion 57, 58 is in the preferred embodiment shown constituted by a series of spring discs arranged in a stack. However, numerous other, equivalent arrangements are possible within the scope of the invention.

Housing 11 includes formed therein an elongate through-going window 59 via which the location of the adjuster nut 26 relative to shank 52, and hence the degree of pre-load applied to the compression spring 24, is visible.

The wall of housing 11 adjacent window 59 includes a series of notches or other marks 61 that provide an approximate indication of the pre-load applied.

In practice there are three notches 61 that are approximately equi-spaced, to represent the position of adjuster nut 26 corresponding to low, medium and high levels of pre-load respectively.

The adjuster mandrel 47 includes at its lowermost end below external portion 49 a downwardly extending, threaded, cylindrical portion 62 that has threadedly received thereon a conventional toolstring connector 63.

Other types of connector, than that shown, are possible within the scope of the invention. For example it is possible to employ a breechlock wireline connector such as that shown in U.S. application Ser. No. 09/730,544, the entire disclosure of which is incorporated herein by reference.

In the portion of the cylindrical member 62 lying between toolstring connector 63 and the external portion 49 of adjuster mandrel 47, there is threadedly received on cylindrical portion 62 a lock nut 64. When tightened against member 49 the lock nut 64 forces the protuberance 54 into frictional engagement with shoulder 56, thereby preventing rotation of adjuster nut 26 relative to shank 52. This in turn locks the set pre-load acting on the compression spring 24.

The jar of the invention is more quickly and reliably used with heavy duty wirelines, that has been possible in the prior art.

What is claimed is:

1. A jar, for use in a downhole toolstring comprising:

a hollow housing;

a jar mandrel;

a latch sub;

at least one latch key;

a cam surface;

a chamber;

a compression spring; and an adjuster, wherein:

the hollow housing supports, moveably retained therein, the jar mandrel and the latch sub;

the jar mandrel and the latch sub are releasably securable together by means of the at least one latch key, each said latch key being moveable between a latching position, in which the latching sub and the jar mandrel are connected together and a release position permitting separation thereof;

the cam surface is engageable with each said latch key to move each said latch key from said latching position to said release position when the jar mandrel occupies a preselected position in the housing;

the compression spring is constrained within the chamber and acts between the latch sub and the hollow housing to bias the jar mandrel when connected to the latch sub away from the preselected position; and the adjuster includes an adjuster mandrel that is rotatable relative to the hollow housing and has an external portion that is engageable from outside the hollow housing via a side thereof, and an adjuster portion that is threadedly connected to the jar mandrel such that rotation of the adjuster mandrel relative to the jar mandrel alters the length of the chamber and hence the degree of compression of the compression spring.

2. A jar according to claim 1 wherein the jar mandrel includes an end protruding from the hollow housing; and a wireline connector secured to the said end, outside the hollow housing.

3. A jar according to claim 1 wherein the hollow housing includes rigidly secured thereto an anvil and the jar mandrel includes a hammer that is strikeable against the anvil under the influence of a stretched wireline following separation of the jar mandrel from the latch sub.

4. A jar according to claim 1 wherein the adjuster mandrel includes at one end within the hollow housing a shank having a threaded end; wherein the compression spring defines a hollow, cylindrical shape such that the shank passes through a central bore thereof; and wherein the adjuster includes a nut that is secured to the adjuster mandrel and threadedly received on the said end of the shank.

5. Ajar according to claim 1 wherein the compression spring includes seriatim in mutual engagement with one another a first spring section, of a first spring rate; and a second spring section of a second spring rate.

6. A jar according to claim 1 wherein the hollow housing includes formed therein an elongate, through-going aperture permitting viewing of the location of the adjuster relative to the housing.

7. A jar according to claim 1 wherein the hollow housing includes formed therein an elongate, through-going aperture permitting viewing of the location of the adjuster relative to the housing, the housing having marked thereon adjacent the aperture one or more distance markings.

8. A jar according to claim 1 wherein the external portion of the adjuster mandrel includes a collar that is moveable relative to the remainder of the adjuster mandrel and has a protuberance that is engageable with a shoulder defined in the hollow housing; and wherein the adjuster mandrel includes a threaded portion having threadedly engaged therewith a lock nut that on tightening engages the collar to force the protuberance into engagement with the shoulder and thereby prevent operation of the adjuster.

9. A jar according to claim 1 wherein the latch sub includes a hollow interior having formed in a surface thereof two or more latch shoulders; and each said latch key has at least two latch surfaces, each said latch surface of a said latch key being engageable with a said shoulder of the adjacent latch sub, when the latch key occupies its latching position with the jar mandrel received in the hollow interior of the latch sub.

10. A jar according to claim 1 wherein each said latch key includes one or more resiliently deformable biassers biasing each said latch key toward said latching position thereof.

11. A jar, for use in a downhole toolstring comprising:

a hollow housing;

a jar mandrel;

a latch sub;

at least one latch key;

a cam surface;

a chamber;

a compression spring; and an adjuster, wherein:

the hollow housing supports, moveably retained therein, the jar mandrel and the latch sub;

the jar mandrel and the latch sub are releasably securable together by means of the at least one latch key, each said latch key being moveable between a latching position, in which the latching sub and the jar mandrel are connected together and a release position permitting separation thereof;

the cam surface is engageable with the at least one latch key to move said latch key from its latching position to the release position when the jar mandrel occupies a preselected position in the housing;

the compression spring is constrained within the chamber and acts between the latch sub and the hollow housing to bias the jar mandrel when connected to the latch sub away from the preselected position;

the adjuster includes an adjuster mandrel that is rotatable relative to the hollow housing and has an external portion that is engageable from outside the hollow housing, wherein the latch sub includes a hollow interior having formed in a surface thereof two or more latch shoulders; and each said latch key has at least two latch surfaces, each latch surface of a said latch key being engageable with a said shoulder of the latch sub, when the latch key occupies the latching position thereof with the jar mandrel received in the hollow interior of the latch sub.

12. A jar according to claim 11 wherein each said latch key includes one or more resiliently deformable biassers biasing it towards its latching position.

* * * * *